United States Patent [19]

Harding et al.

[11] Patent Number: 4,922,557

[45] Date of Patent: May 8, 1990

[54] OUTDOOR TOILET HOLDING TANK VENTILATION SYSTEM

[75] Inventors: George W. Harding, Clearwater, Fla.; Rodney M. Mullett, Hammond, Ind.

[73] Assignee: Poly-John Enterprises Corp., Whiting, Ind.

[21] Appl. No.: 320,324

[22] Filed: Mar. 8, 1989

[51] Int. Cl.[5] ..... A47K 11/04; E03D 9/04

[52] U.S. Cl. ..... 4/477; 4/347; 4/218; 4/DIG. 12; 4/321

[58] Field of Search ..... 4/321, 322, 218, 347–352, 4/213, 477, 478, 482, DIG. 12, 460

[56] References Cited

U.S. PATENT DOCUMENTS

| | | | |
|---|---|---|---|
| 3,192,539 | 7/1965 | Martz | 4/218 |
| 3,776,383 | 12/1973 | Hargraves | 4/DIG. 12 |
| 3,873,445 | 3/1975 | Bussard | 4/347 |
| 3,938,201 | 2/1976 | McGrew | 4/218 |
| 4,174,371 | 11/1979 | Bell et al. | 4/DIG. 12 |

*Primary Examiner*—Henry J. Recla
*Assistant Examiner*—Keith Kupferschmid
*Attorney, Agent, or Firm*—Harness, Dickey & Pierce

[57] ABSTRACT

The waste material holding tank located within a portable, outdoor toilet cabana is vented to atmosphere by a vent pipe extending upwardly from the tank to the roof of the toilet cabana. A small, electrical blower fan is mounted upon the upper, open end of the vent pipe for sucking air from the holding tank and blowing the air to outside atmosphere. A solar energy panel is mounted upon the roof of the cabana near the fan and is electrically connected to the fan. The panel generates electrical energy in response to a predetermined level of sunlight for electrically energizing the fan. Thus, the fan circulates air through the holding tank during the items that the sun is shining upon the cabana, to reduce the solar heat build-up in the holding tank for reducing the generation of noxious odors caused by heat induced reactions in the waste material in the tank.

6 Claims, 1 Drawing Sheet

OUTDOOR TOILET HOLDING TANK VENTILATION SYSTEM

BACKGROUND OF INVENTION

This invention relates to a system for circulating air through the waste material holding tank of an outdoor, portable toilet for reducing the solar heat induced bacteriological activity which generates noxious odors.

Outdoor, portable toilets generally comprise a relatively small size cabana or outhouse structure within which the toilet equipment is located. The sewage or toilet waste material normally is kept within a holding tank located within the cabana. From time to time, the holding tank is pumped to remove the waste material contained therein. Also, the entire toilet cabana is made in such a way that it can be lifted upon a truck and moved from one place to another as needed or for replacement or cleaning purposes.

Examples of this type of outdoor, portable toilet are disclosed in prior Patent No. 4, 446,585 issued May 8, 1984 to Harding et al.; U.S. Pat. No. 4,637,229 issued Jan. 20, 1987 to Harding; U.S. Pat. No. 4,577,351 issued Mar. 25, 1986 to Harding; and in U.S. Pat. No. 4,761,840, issued Aug. 9, 1988 to Harding.

During times that these cabanas are exposed to direct hot sunlight, such as during the summer months in the northern climates and during a substantial portion of the year in the southern climates, heat builds up within the cabana. Particularly, heat tends to build-up within the holding tank located inside the cabana. For example, the temperature in the holding tank may be 30 degrees F. hotter than the temperature in the cabana. Such heat accelerates the bacteriological activity and biological and chemical reactions in the waste material combined within the holding tank. This results in the generation of noxious odors.

Usually, the holding tanks are vented, through vent pipes or suitable openings, to the exteriors of their cabanas. However, such venting, where used, does not solve the problem of preventing or substantially reducing the generation of strong, noxious odors caused by solar heat-induced activities in the waste material contained in the holding tank.

Thus, this invention is concerned with reducing the noxious odors caused by heat build-ups which take place in outdoor toilet holding tanks when the sun is shining upon the toilet cabana.

SUMMARY OF INVENTION

This invention contemplates a ventilation system which forcibly circulates air from the toilet cabana through the holding tank of an outdoor, portable toilet, during the times that the toilet cabana is exposed to the sun, so as to reduce the generation of noxious odors. Thus, a vent pipe, which extends from the holding tank through the top of the cabana, is provided with an easily installable and removable electric motor-powered blower fan assembly which sucks air through the holding tank from the cabana interior and blows the air to atmosphere above the toilet cabana when the motor is electrically energized. Solar responsive electrical generating panels are mounted upon the roof of the cabana for generating electricity upon being exposed to predetermined levels of sunlight. Hence, when the sun shines upon the cabana, electrical energy is generated and is transmitted, through an electrical connection, directly to the motor for operating the fan. Consequently, the fan will operate only during times that the cabana is exposed to sunlight so as to continuously dispel the solar heat building up in the holding tank.

An object of this invention is to provide a simple, inexpensive, ventilating unit which can be easily applied upon, or removed from, a typical outdoor, portable toilet which includes a holding tank vent pipe, for producing a ventilating air circulation through the cabana and holding tank during the times the toilet cabana is exposed to the sun to reduce heat build-ups in the hoolding tank.

Another object of this invention is to provide a method for dispelling solar-induced heat from a portable toilet holding tank, during the time that the toilet cabana is exposed to sunlight. This reduces bacteriological and chemical reactions which take place in a heated holding tank and which produce noxious odors. The method includes forcibly circulating ambient air from the cabana through the holding tank by sucking air from the tank and blowing the air into the atmosphere above the cabana by means of a solar energy operated fan mounted upon the discharge end of a vent pipe communicated with the holding tank.

Still a further object of this invention is to provide a simplified electric motor-fan venting system, which is operated by solar energy-electrical panels, which produce electrical energy and operate the fan only in response to sunlight. Thus, the fan is automatically turned on and off by the sun and is utilized during times that the sun shines.

In prior outdoor, portable toilet constructions, venting systems have been utilized to vent the inside of the portable toilet cabana or house, without recognition of the special problem caused by the heat build-up in the waste material holding tank. Thus, a significant object of this invention is to remove from the holding tank, to the extent possible, the sun-caused heat building up in the holding tank which causes increased bacteriological or biological action therein, regardless as to whether or how the remainder of the cabana is otherwise vented.

Further objects and advantages of this invention will become apparent upon reading the following description of which the attached drawings form a part.

DETAILED DESCRIPTION

Figure 1:
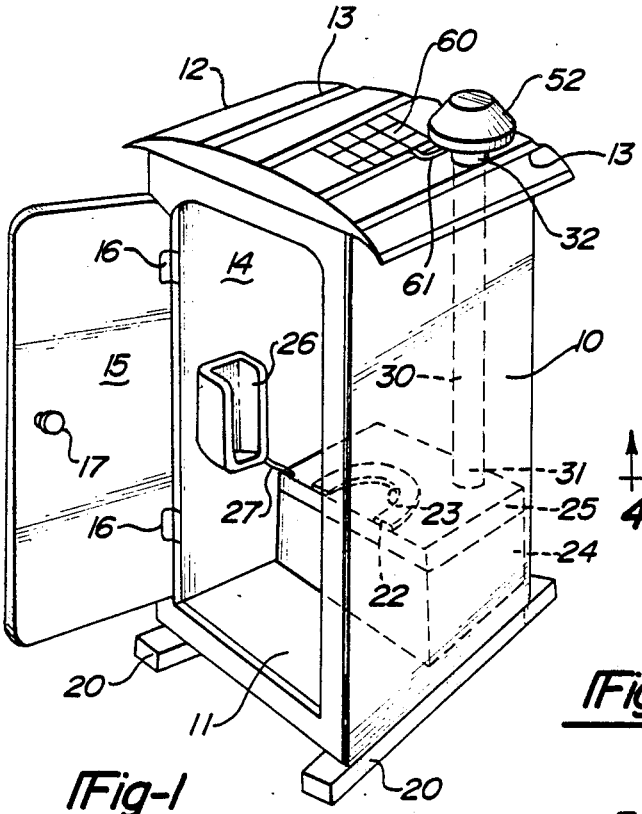
FIG. 1 is a perspective, schematic view of an outdoor, portable toilet.

FIG. 1 illustrates a typical outdoor, portable toilet construction which includes a cabana or out-house structure 10. The cabana has a floor 11 and a roof 12. The walls and roof of the cabana may be made of thermo-formed plastic sheet material with suitable reinforcing. By way of example, strengthening ribs 13 are shown on the roof 12.

The cabana has a door-way 14 which is normally closed by a door 15. The door is secured to one of the door-way jams by suitable hinges 16. A locking handle 17 or latch is provided for manually opening and closing the door and latching it closed.

Wood support skids 20 are secured to the bottom of the floor of the cabana. The cabana is supported upon the skids which enables the cabana to be moved by sliding it upon the ground or, alternatively, to be lifted up by a fork-lift device or the like. Typically, these outdoor toilets are carried by truck to the site where they will be used and are lifted off the truck and placed upon the ground with suitable mechanical handling equipment. The toilet remains at the site for as long as desired and then is removed by lifting it upon a truck so that it may be carried away. The toilet that is removed from a site may be easily replaced by another toilet should it become damaged or require extensive cleaning.

A toilet seat 22 is mounted, over an opening 23, in a waste holding tank 24. The top of the holding tank is closed with a cover 25. In addition, a urinal 26 may be mounted on the wall and connected by a drain tube 27 to the holding tank. Thus, the holding tank receives and stores sewage or waste material. In a typical outdoor toilet installation, the waste tank is periodically pumped, utilizing a tank truck with a hose and pumping equipment for cleaning the waste material holding tank.

Conventionally, the cabana is vented by a suitable vent pipe or by screened vent windows to window openings or the like. In addition, the holding tank may also be vented by a pipe extending from the tank through the cabana wall or roof to outside atmosphere.

Figure 5:
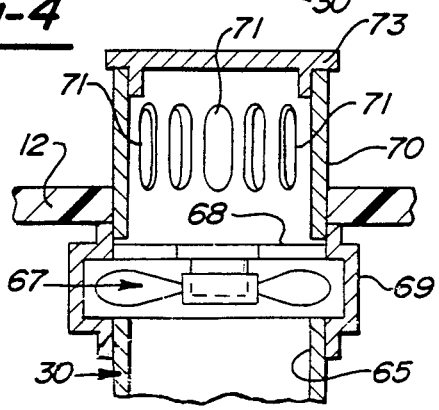
FIG. 5 illustrates a modified ventilation unit arrangement.

In this case, a vent pipe 30 is provided for venting the holding tank. The lower end 31 of the pipe is connected to and opens into the holding tank. The upper end 32 of the vent pipe extends through the roof 12 and extends above the roof for a short distance, as indicated in FIG. 5.

Figure 4:
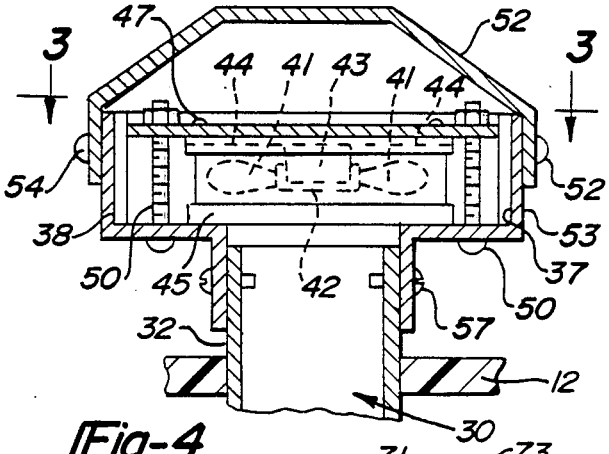
FIG. 4 is a cross-sectional elevational view, partially schematic, showing the ventilation unit secured to the upper end of a vent pipe, and taken in the direction of arrows 4–4 of FIG. 3.

The ventilation and air circulation unit for the holding tank includes an adaptor tube 35 (see FIG. 4). The tube 35 is of a size to snugly fit around the upper end 32 of the vent pipe.

An enlarged, flat flange 36 is formed on the upper end of the adaptor tube 35. This flange has a peripheral, upwardly bent rim 37 which has flattened corners 38.

A flat, electrically operated motor-blower fan assembly 40 is positioned upon the flange 36 and centered over the adaptor tube 35. A number of commercially available motors may be used for this purpose, depending upon the cost, commercial availability, blowing capacity and sturdiness. An example of a commercially available fan motor is a solid-state brushless motor, D.C. series, type D36T10, manufactured by Globe Motors of Dayton, Ohio. The unit has an axial fan mounted upon it, so that roughly 36 c.f.m. may be blown at about 2350 R.P.M. using 1.7 watts power or about 0.0140 line amps. However, the selection of a particular motor and fan may be made by those skilled in the art, considering the relevant cost, durability and like factors to be considered for a particular commercially available fan.

The drawings schematically illustrate fan blades 41 secured to a rotatable, cup-like hub 42 that is mounted upon a small electrical motor 43. The motor is supported upon spokes 44 connected to a surrounding tube or ring 45. The ring 45 is placed upon the flange 36 and centered over the adaptor tube 35. The ring is covered by a mounting plate 46 and is secured to that plate by suitable screws 47. The plate has a central opening 48 for the passage of air. The mounting plate is fastened by bolts and nuts 50 to the flange 36 through suitable aligned holes formed in the plate and flange.

Figure 3:
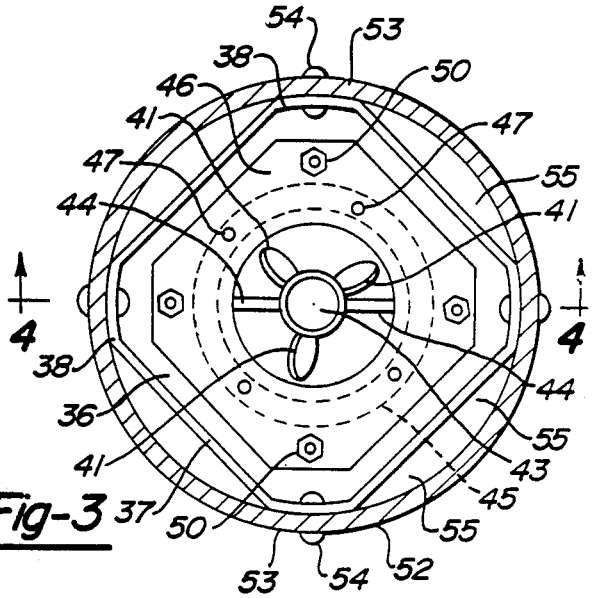
FIG. 3 is an enlarged, cross-sectional, plan view of the ventilation unit taken in the direction of arrows 3—3 of FIG. 4.
Figure 2:
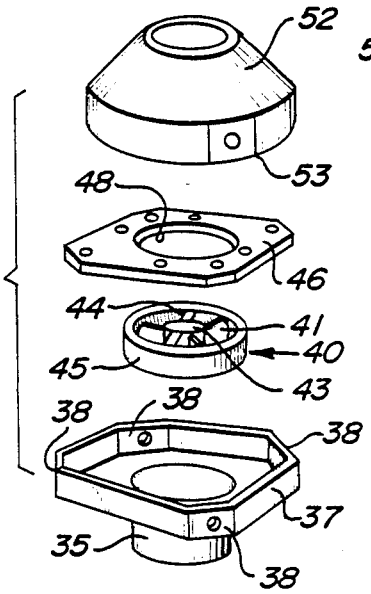
FIG. 2 is a perspective, disassembled view of the ventilation unit.

An inverted, bowl-like cover or canopy 52 is positioned over the rim 37. The cover has a peripheral rim with flattened portions 53 which overlap the flattened corners 38 of the rim and are fastened thereby by means of rivets or the like fasteners 54. As shown in FIG. 3, there are spaces 55 between the interior of the cover and its rim and the flange 36 and its rim 37. These spaces provide passageways for air to circulate beneath the cover and to the atmosphere.

In use, the ventilating unit is positioned over the upper end 32 of the vent pipe and the adaptor tube 35 is slipped over the vent pipe where it is frictionally held. In addition, screws 57 are inserted to fasten the pipe and tube together. By removing the screws, the ventilation unit may be removed from the vent pipe and replaced when desired, or it may be applied when needed and removed entirely when not needed. Thus, the unit may be flexibly used as an accessory for outdoor toilets.

In order to power the ventilation unit, a solar energy panel 60 is fastened upon the roof near the upper end of the vent pipe. The panel is a type, which is available commercially, that reacts to sunlight and generates electrical energy from the sunlight. That is, whenever the intensity of the sunlight reaches a predetermined level, the unit begins generating electricity. Conversely, when the sunlight decreases below a predetermined level, the unit discontinues generating electricity.

An example of a commercially available solar panel is a solar photo-voltaic, flexible laminate formed of amorphous silicon, manufactured by Sovonics System of Troy, Mich. A 7"×20" unit, comprising 10 cells, produces about 11.2 volts with about 2.35 watts.

The solar panel is connected by an electric conduit 61 to the fan motor. Hence, whenever the sunlight reaches a predetermined intensity, the panel generates electrical power and automatically actuates the fan motor. As long as electricity is supplied to the fan motor by the solar panel, the fan is operated to suck air from the holding tank and to discharge the air around the inside of the cover to atmosphere above the cabana. Air is pulled into the holding tank from the interior of the cabana through the opening 23 in the toilet unit. This air movement removes odors and heat. It prevents heat from building up in the holding tank during the time that the sun is shining upon the cabana. It is during that time that the heat build-up in the holding would be most intense. The dissipation of heat from the holding tank reduces the activity in the waste material which reduces the generation of noxious odors. During the time that the sun is not shining upon the unit, the holding tank is not as subject to increased heat build-ups. Thus, the fan is not operated.

FIG. 5 schematically illustrates a modification wherein the fan is installed beneath the cabana roof 12, with the cabana. Here the upper end 65 of the vent pipe 30 is terminated beneath the roof. A fan housing 69 is fitted upon the upper end of the vent pipe and fastened thereto by suitable mechanical fasteners, such as screws (not shown).

A fan assembly 67, mounted upon a support 68, is fastened within the fan housing 69. The fan housing is connected to a cylindrically shaped cover vent 70 which is provided with ventilation slots 71 for exhausting the air sucked by the fan from the vent pipe 30. The upper end of the cover vent is covered by a suitable cap-like cover 73 to protect against the entry of rain, snow, etc. Locating the fan assembly within the cabana interior protects it against vandalism or other damage since it is not as visible or accessible.

This invention may be further developed within the scope of the following claims. Accordingly, it is desired that the foregoing description be read as being merely illustrative of an operative embodiment of this invention and not in a strictly limited sense.

Having fully described one operative embodiment of this invention, we now claim:

1. An outdoor toilet holding tank ventilation system for reducing the generation of noxious odors by solar energy heat build-ups in a toilet waste material holding tank located within a portable, outdoor toilet cabana containing toilet equipment, comprising:

a vent pipe having a lower end opening into the toilet waste material holding tank and an opposite upper, open end portion which extends into the cabana;

a small, electrical motor-operated, blower fan mounted upon the vent pipe open end operation for blowing air outside of the cabana, the fan being located within the cabana, just beneath the roof of the cabana and opening outwardly of the cabana roof, said fan including a housing fitted upon the open end of the vent pipe and a cover vent extending from said housing out said cabana roof to exhaust to atmosphere, said cover vent including a vent tube extending from said fan housing through the cabana roof a short distance above the roof, a plurality of axial slots are formed in the vent tube for enabling exhaust, and a cap covering said vent tube to protect against entry of rain or the like, said housing and vent cover are easily and readily removable from said vent pipe to enable changing, replacing, or the like, when needed;

a solar heat-electrical energy generating panel mounted upon the exterior of the cabana for exposure to natural sunlight, to generate electrical energy in response to direct exposure to predetermined levels of sunlight shining thereupon;

said panel being electrically connected to the fan motor for providing electrical energy for activating the fan only during periods of such predetermined levels of sunlight applied to the cabana;

whereby the fan sucks air out of the waste holding tank through the vent pipe and blows the air out of the pipe to atmosphere for causing air to circulate through the cabana and through the tank and, thereby, to remove some of the solar energy-caused heat concentrated in said tank and, as a result, reduce heat-caused chemical or bacteriological activity within the waste material in the tank for reducing the generation of noxious odors resulting from such activity.

2. An outdoor toilet holding tank ventilation system as defined in claim 1, and said cabana having a roof with the solar panel being mounted upon the exterior surface of the roof for exposure to sunlight directed against said roof.

3. An outdoor toilet holding tank as defined in claim 2, and said solar panel being mounted upon the cabana roof near the outside vent pipe end and fan and being connected to the fan motor by an electrically conductive conduit located on the roof.

4. An outdoor toilet holding tank ventilation system for reducing the generation of noxious odors by solar energy heat build-ups in a toilet waste material holding tank located within a portable, outdoor toilet cabana containing toilet equipment, comprising:

a vent pipe having a lower end opening into the toilet waste material holding tank and an opposite upper, open end portion which extends through the cabana and opens to outside atmosphere;

a small, electrical motor-operated, blower fan mounted upon the vent pipe open end portion for blowing air outside of the cabana, the blower fan comprising a small, relatively flat, motor-fan assembly which is generally centered over the outside end of the vent pipe, mounting means securing the motor-fan assembly upon the vent pipe, a cover positioned over, and spaced a short distance above, the motor fan assembly, and secured to the outside end of the vent pipe, with at least portions of the interior of the cover being unobstructed so that air from the fan blows against the inside surface of the cover and is directed downwardly towards and outwardly of the cover for exhausting to atmosphere;

a short length vent adaptor tube sized to connect with the upper end portion of the vent pipe, and with the adaptor tube having a radially extending substantially flat flange formed on its upper end, upon which flange the motor fan is mounted in roughly axial alignment with the upper end portion of the vent pipe;

a substantially continuous rim formed upon and extending from the peripheral edge of said flange and the cover being secured to said rim, with the flange exterior, peripheral edges being shaped so that selective portions of the flange extend further from the center of the flange than the remaining portions of the flange, so as to provide unobstructed spaces for the passage of air outwardly from the cover around said flange;

a solar heat-electrical energy generating panel mounted upon the exterior of the cabana for exposure to natural sunlight, to generate electrical energy in response to direct exposure to predetermined levels of sunlight shining thereupon;

said panel being electrically connected to the fan motor for providing electrical energy for activating the fan only during periods of such predetermined levels of sunlight applied to the cabana;

whereby the fan sucks air out of the waste holding tank through the vent pipe and blows the air out of the pipe to atmosphere for causing air to circulate through the cabana and through the tank and, thereby, to remove some of the solar energy-caused heat concentrated in said tank and, as a result, reduce heat-caused chemicals or bacteriological activity within the waste material in the tank for reducing the generation of noxious odors resulting from such activity.

5. An outdoor toilet holding tank ventilation system as defined in claim 1, and with the motor fan assembly being located closely adjacent to the cabana roof for blowing air from the holding tank outwardly of the cabana roof.

6. An outdoor toilet holding tank ventilation system as defined in claim 5, and including removable fastening means securing the vent adaptor tube and the vent pipe outside end portion together so that the motor fan assembly, cover and vent adaptor tube form a unit which may be applied to or removed from the vent pipe for maintenance, replacement or removal when not needed.

* * * * *

UNITED STATES PATENT AND TRADEMARK OFFICE

CERTIFICATE OF CORRECTION

PATENT NO. : 4,922,557

DATED : May 8, 1990

INVENTOR(S) : Harding, et al

It is certified that error appears in the above-identified patent and that said Letters Patent is hereby corrected as shown below:

In the Abstract, 57 line 12, change "items" to --times--

In col. 1, line 22, change "4,637,229" to --4,637,299--

In col. 1, line 35, change "combined" to --contained--

In col. 2, line 11, change "hoolding" to --holding--

In col. 3, line 30, change "or" to --be--

In col. 3, line 57, change "0.0140" to --0.140--

In col. 4, line 8, change "thereby" to --thereto--

In col. 4, line 30, change "Converselly" to --Conversely--

In col. 4, line 59, change "with" to --within--

In col. 5 line 21, change "operation" to --portion--

Signed and Sealed this

Fourth Day of August, 1992

*Attest:*

DOUGLAS B. COMER

*Attesting Officer*

*Acting Commissioner of Patents and Trademarks*